US005547372A

United States Patent [19]

Smith

[11] Patent Number: 5,547,372

[45] Date of Patent: Aug. 20, 1996

[54] FUEL FIRED BURNERS

[75] Inventor: Colin Smith, Epsom, United Kingdom

[73] Assignee: British Gas plc, London, England

[21] Appl. No.: 424,482

[22] Filed: Jul. 5, 1995

[30] Foreign Application Priority Data

Nov. 12, 1992 [GB] United Kingdom ..... 9223728

[51] Int. Cl.[6] ..... F23D 14/12

[52] U.S. Cl. ..... 431/328

[58] Field of Search ..... 431/328

[56] References Cited

U.S. PATENT DOCUMENTS 5,417,566 5/1995 Ishikawa et al. ..... 431/328

FOREIGN PATENT DOCUMENTS 462348 3/1937 United Kingdom .

*Primary Examiner*—Carroll B. Dority

*Attorney, Agent, or Firm*—Oblon, Spivak, McClelland, Maier & Neustadt, P.C.

[57] ABSTRACT

A fuel gas-fired premixed burner includes a flame strip having a plurality of through slots. Each slot includes a relatively narrow dimension portion that opens stepwise by means of a land into an outlet portion of a substantially constant relatively wide dimension. Under given conditions the burner flame stabilizes either at the outer end of the outlet portion (at a relatively high heat input range) or on the lands (at a relatively low heat input range) accompanied by reduction of the resonance tendency of the burner over those heat input ranges.

6 Claims, 3 Drawing Sheets

FUEL FIRED BURNERS

Figure 1:
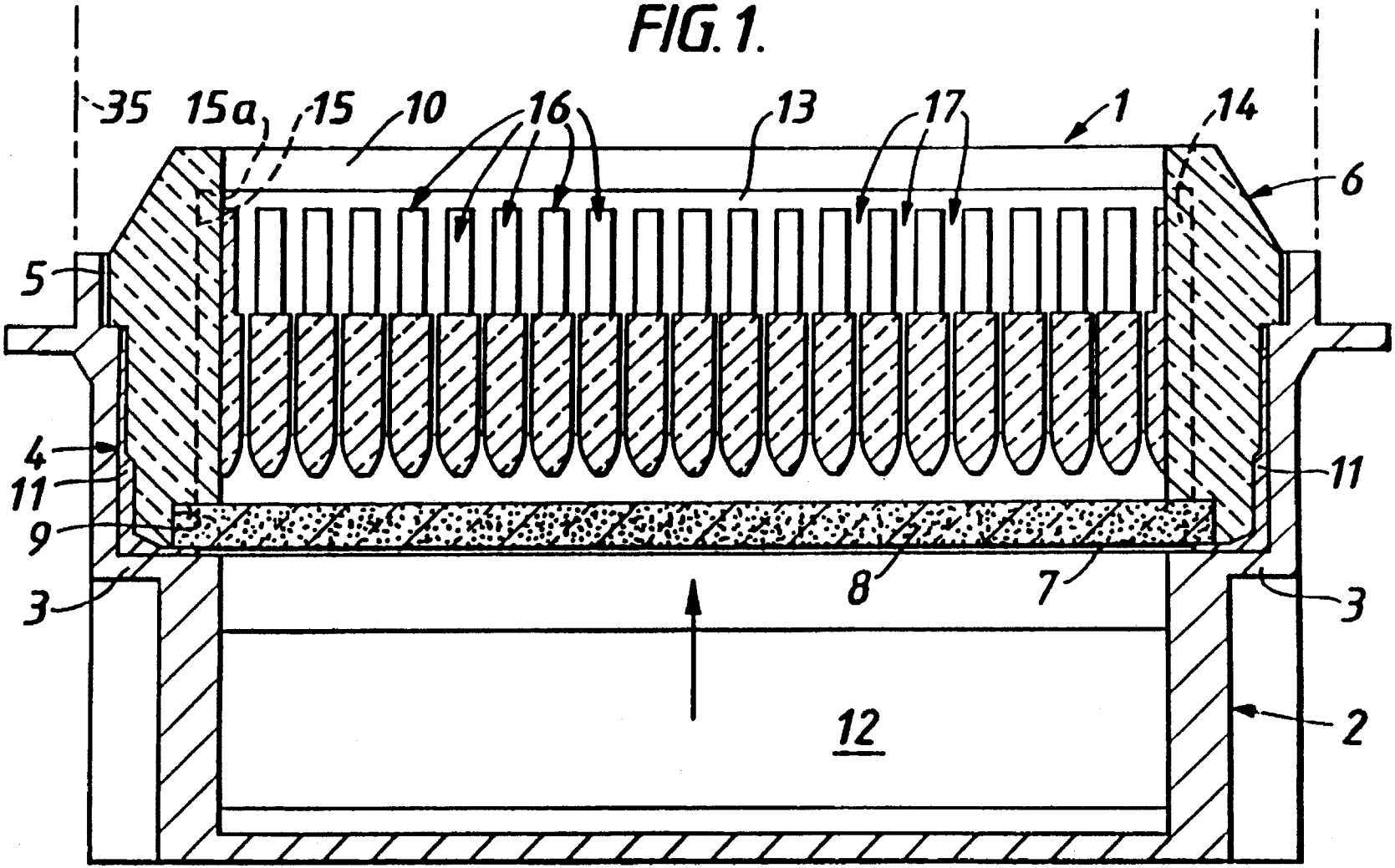

The present invention relates to a fuel-fired burner, and particularly a gas-fired burner, which preferably is of the fully premixed type i.e. one in which the fuel gas is mixed with all the combustion air in a mixing chamber before the gas is combusted.

One type of fully premixed burner comprises a plenum chamber into which an externally prepared mixture of air and fuel gas, such as natural gas, is introduced before being discharged more or less uniformly through ports or slots in a flame support such as a block, plate or strip which may or may not form a part or wall of the chamber. The mixture is combusted at a point within or downstream of the associated flame support, to produce combustion products which then enter a first enclosure leading to a second enclosure such as a heat exchanger when the burner is used as a heat source in a heating appliance, such as a boiler. A typical fully premixed burner is described in our published UK Patent Application No. 2176588A.

The problem with burners of this type is that there is a tendency under certain conditions for them to generate unacceptable intensities of so-called resonant combustion noise, particularly when enclosed in a heating appliance and when the burner is operated at a relatively high heat output per unit of burner surface area.

The invention provides a fuel fired burner comprising a chamber for receiving a premixture of fuel and air, a flame support extending across the chamber and having a plurality of elongate through slots or ports, each slot including a portion which has an exit opening of a relatively narrow dimension, which exit opening opens stepwise by means of a land into an outlet portion of the slot for containing or supporting the flame fronts when the burner is operating normally, each outlet portion comprising at least one substantially constant relatively wide dimension section.

Each outlet portion may comprise two or more successive relatively wide dimension sections; successive sections, in a direction away from the exit openings, being of greater but substantially constant dimensions and opening stepwise by means of a land into each other.

The dimensions of the features of the flame support are such as to enable or permit a flame, when the burner is operating over the intended heat output capacity range, to stabilise either at or on the outer end of the outlet portion (at a relatively higher heat input range) or on the or one of the lands (at a relatively lower heat input range or at respective different relatively lower heat input ranges).

Applicants presently believe that the lands (and the outer end of the slot outlet portion), for given burner heat input ranges, provide regions whereat the flame stabilises in such a way that the balance between mixture flowrate and burning velocity can be achieved with relatively short flat flames being produced.

Applicants have found that such an arrangement leads to substantial reduction or elimination of the resonance tendency of the premixed burner for given heat input ranges.

Conveniently, each relatively narrow dimension exit opening terminates a slot portion of substantially constant dimension.

Each slot may have a converging inlet portion. Preferably, the converging inlet may have a varying angle of convergence. For example, each side wall of the converging inlet portion is of a convex elliptical curvature.

The invention also provides a flame support for use in a fuel fired burner, which flame support comprises a plurality of elongate through slots, each slot including a portion which has an exit opening of a relatively narrow dimension, which exit opening opens stepwise by means of a land into an outlet portion of the slot for containing or supporting flame fronts when the flame support is incorporated in the burner for a given heat output range, each outlet portion comprising at least one substantially constant relatively wide dimension section.

Figure 2:
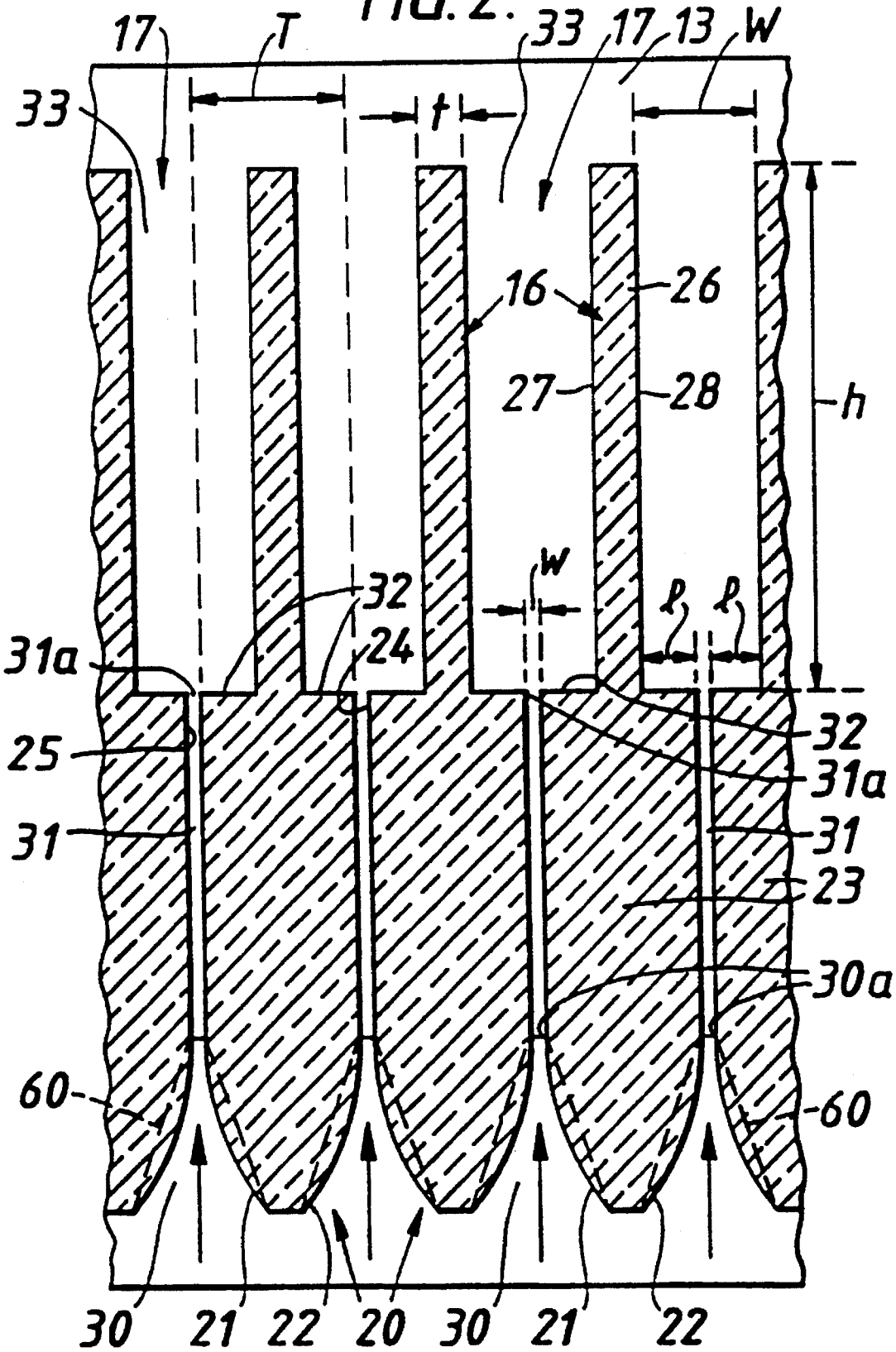
Figure 3:
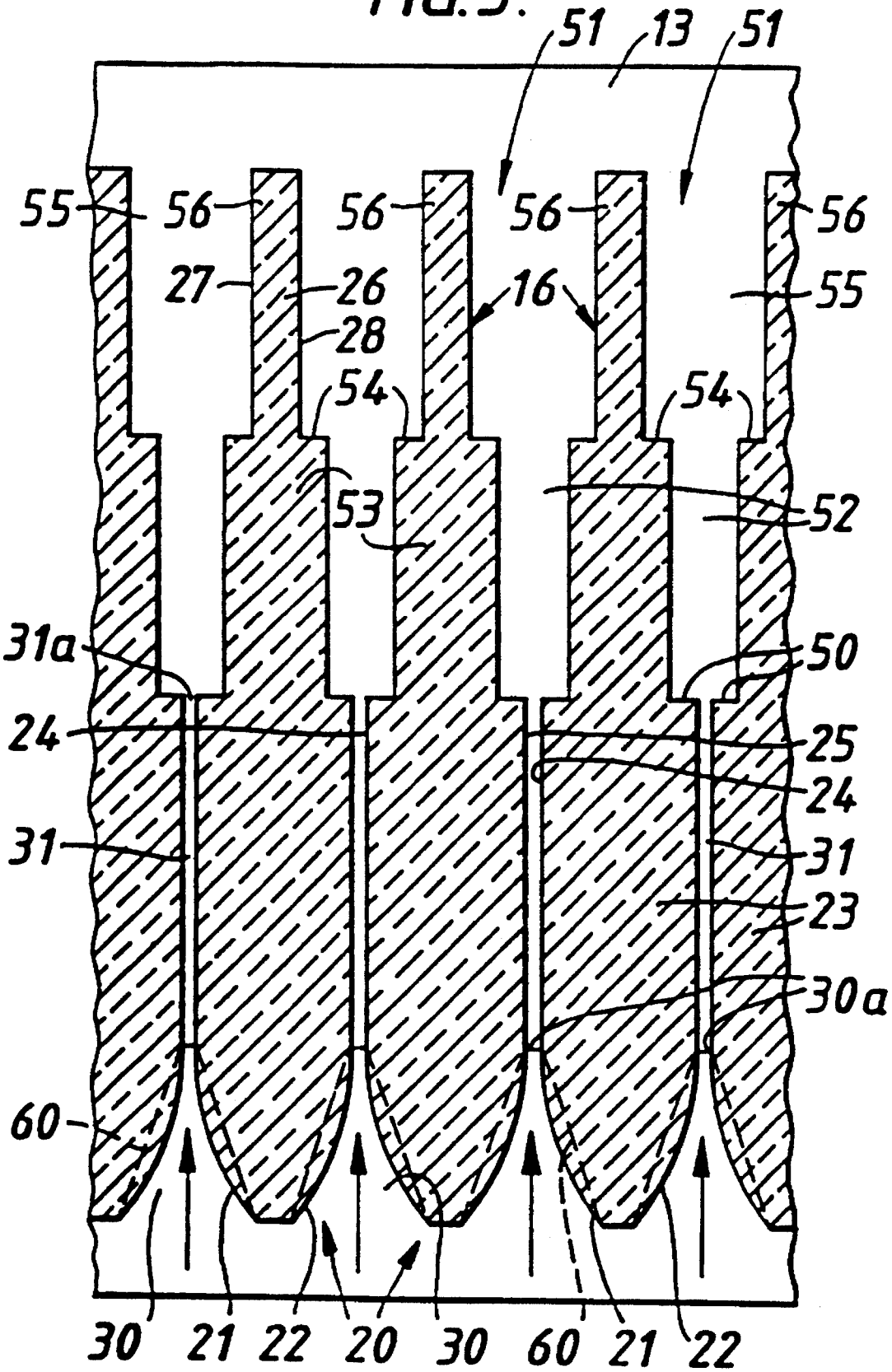

FIG. 1 is a sectional view of one embodiment of burner according to the invention, FIG. 2 is a sectional view on an enlarged scale of part of the flame supporting element as shown in FIG. 1, and FIG. 3 is a sectional view of a modified embodiment of flame supporting element.

Referring to FIGS. 1 and 2, a gas-fired burner 1 of the fully premixed kind is shown in an upwardly firing mode. The burner 1 comprises an elongated lower chamber 2 defining a plenum chamber. A peripheral wall 3 extends horizontally outwardly from the lower chamber 2 to form an upper chamber or enclosure 4 which has an opening 5 at the top.

A hollow, generally rectangular support member 6 is mounted within the upper chamber 4 by means of securing pins (not shown) which extend through the wall of the enclosure 4 into the support member 6.

The opening 7 at the bottom of the support member 6 is filled by a porous fuel gas/air distribution plate 8 which is accommodated within a recess 9 extending around the inside and at the base of the support member 6. At the top of the support member there is an opening 10.

A seal 11 is sandwiched between the support member 6 and the wall of the enclosure 4. As can be seen from FIG. 1 the seal 11 is also sandwiched between the lower peripheral edge portions of the distribution plate 8 and the upperside of the peripheral wall 3.

The porous distribution plate 8 provides an upper wall to the plenum chamber 2.

Entry of air/fuel gas premixture to the plenum chamber 2 is via an inlet 12 in the wall of the chamber 2.

A ceramic flamestrip 13 forming a flame support is mounted by means of the support member 6 within the upper chamber 4 to provide in effect a wall thereacross. The flamestrip 13 is generally of rectangular shape and comprises a peripheral wall 14 which is located in a recess 15 that extends around the inner periphery of the support member 6 and is held between the shoulder **15*a* of the recess 15 and the upperside of the distribution plate 8**.

A plurality of equally spaced generally vertical partitions or walls 16 is arranged in a row across the flamestrip 13. Adjacent ones of the walls 16 define therebetween a plurality of burner ports in the form of elongate slots 17 that extend generally vertically through the flamestrip.

Each wall 16 has a lower tapered portion 20 having curved side surfaces 21,22 of convex elliptical form and tapering in downwardly direction, a relatively wide intermediate wall portion 23 having parallel sides as at 24 and 25, and a relatively narrow upper wall portion 26 having parallel sides as at 27 and 28.

The plurality of equivalent, equispaced elongate slots 17 is defined between adjacent walls 16. The slots 17 serve as ports or outlets for fuel gas/air premixture for subsequent ignition as will be described below. Each slot 17 has an inlet portion 30 which is defined between adjacent tapered lower wall portions 20 and converges to an end **30*a* which leads to a substantially constant relatively narrow dimension intermediate straight portion 31 defined between adjacent parallel wall portions 23. The relatively narrow dimension straight portion 31 has an exit opening 31*a* which opens stepwise by means of a land 32 into an outlet portion 33 of substantially constant relatively wide dimension and defined by adjacent parallel wall portions 26. The portion 31** is sufficiently narrow to prevent lightback therethrough.

In the ready-for-use condition, the assembly of components described above would be mounted, for example, on a combustion chamber 35 as shown in chain-dotted lines in FIG. 1.

In use, a premixture of fuel gas (natural gas) and air is supplied by way of the inlet 12 to the plenum chamber 2. The mixture then passes through the porous plate 8 which distributes the mixture uniformly and at a low intensity of turbulence to the slotted burner flamestrip 13. The plate 8 also improves the resistance of the burner to combustion resonance. To maximise this latter characteristic it is advantageous for the porous plate to be located as close as possible to the inlet portions 30 of the slots 17.

After passing completely through at least the inlet portion 30 and the substantially constant relatively narrow dimension portion 31 of the slot 17 the air/gas mixture is ignited by ignition means (not shown), for example spark electrodes, so as thereafter to combust steadily, without further assistance from the ignition means, at or downstream of the lands 32. The burner fires upwardly through the opening 10 into the combustion chamber 35. As mentioned earlier, the dimensions of the features of the burner and flamestrip, for a given enclosure or combustion chamber, are chosen so that the burner can operate as intended, within predetermined parameters.

By way of example only, in an arrangement used by the Applicants in experiments, dimensions were as follows having regard to the reference letters in FIG. 2:

Width of relatively narrow dimension slot portion (w)= 0.65 mm.

Width of relatively wide dimension slot portion (W)=3.65 mm.

Length of relatively wide dimension slot portion (h)=15 mm.

Width of each land or step portion at the exit of the relatively narrow dimension slot portion ( )=1.5 mm.

Thickness of the walls defining therebetween the relatively narrow dimension slot portion (T)=4.5 mm.

Thickness of the walls defining therebetween the relatively wide dimension slot portion (t)=1.5mm.

The length of the flamestrip which is shown in FIG. 1=100 mm.

The breath of the slots (and approximate width of the flamestrip)=40 mm.

The air/natural fuel gas used had an aeration of 130% of stoichiometric requirements.

In Applicants experiments it was found that for heat input levels of greater than 4 kW, the flame (in blue flame mode) always stabilised at the top of the relatively wide slot portion 33. For heat input levels from 4 kW to 12 kW it was found that no or substantially no resonance occurred. Above 12 kW it was found that resonance started to occur.

When the heat input level was reduced to below 4 kW, the flame gradually burned back to and stabilised at the lands 32 at the exit opening 31*a* of the relatively narrow slot portion 31.

With the flame stabilised at the exit of lower narrower slot portion 31, that section of the burner began operating in a radiant manner. The time taken for the burner operation to change from completely blue flame to entirely radiant mode depended on the heat input being used. In these experiments Applicants found that when the burner was operating in an entirely radiant mode at a heat input of 2 kW no resonance occurred, but that resonance did occur, for example, at 3 kW.

From the above it can be seen that over a heat input range at a relatively high level the flame stabilises on top of the relatively wide slot portion 33 and burns there quietly. If the heat input is raised above the upper limit of the range then resonance can occur. If the heat input level is reduced below the lower limit of the range the flame is more inclined to burn within the slot portion 33 and then stabilise on the land 32 at the upper end of the relatively narrow slot portion 31 and burn there quietly over a relatively low level heat input range. Burning within the relatively wide slot portion 31 at the land 32 causes the burner to become hot and operate in a radiant mode. If the relatively low heat input level is outside the relatively low level range then resonance can occur.

Applicants investigations also indicated that if the nature of the enclosure or combustion chamber above the burner was altered then different results were obtained. It could therefore be necessary, in order to obtain substantially 'no resonance' operation, to operate the burner over different ranges of heat input and/or to have a flamestrip in which one or more of the various features or parameters were of different dimensions.

It will be appreciated that the burner would be designed or 'tailored' with its intended operating range(s), use and environment in mind, in order to obtain 'no resonance' conditions.

In the Applicants above described experiments with the premixed burner, emission levels of NOx and other pollutants were found to be low.

FIG. 3 shows part of a modified embodiment of flamestrip for use in the burner. Parts in FIG. 3 that correspond to similar ones in FIG. 2 have been given the same reference numbers. In this embodiment each lower relatively narrow constant dimension slot portion 31 has an upper exit opening 31*a* which opens stepwise by means of land 50 into a lower section 52 of wider constant dimension of a two section slot outlet portion 51. The lower outlet sections 52 are defined between parallel wall portions 53. The upper end of each outlet portion 52 opens stepwise by means of land 54 into an upper slot outlet section 55 of greater constant width dimension. The upper outlet sections 55 are defined between parallel wall portions 56 which extend upwardly from the wall portions 53.

As can be seen from FIG. 3, the slot portions 31 and sections 52 and 55 which are of successively greater widths but which, individually, are of substantially constant dimensions.

The purpose of the land 54 is to provide a stabilising region for a flame associated with a heat input range that is lower than the range associated with flame stabilisation at the top of upper section 55.

The purpose of the land 55 is to provide a stabilising region for a flame associated with a heat input range that is lower than the range associated with flame stabilisation at the land 54.

Whilst particular embodiments of the invention have been described above, various modifications or improvements may be made. For example, the converging inlet portions 30 need not be defined between tapered walls 20 having sides 21,22 of convex elliptical form, but may have straight sides as illustrated diagrammatically by the dotted lines 60 in FIGS. 2 and 3. Also, the flamestrip may have more than two outlet sections, with successive sections, in a direction away from the exit openings 31*a*, being of increased widths but which, individually, are of substantially constant widths. The sections open stepwise by means of a land into each other in the manner suggested by FIG. 3. In a burner with a flamestrip employing such a series of sections separated by lands or steps, the purpose would be for the dimensions to be such as to enable the flame to stabilise on an appropriate land or step and avoid resonance occurring over several different heat input ranges.

I claim:

1. A fuel fired burner comprising a chamber for receiving a premixture of fuel and air, a flame support extending across the chamber and having a plurality of elongate slots extending therethrough, each slot having a converging inlet portion, each slot including a portion which has an exit opening of a relatively narrow dimension, which exit opening opens stepwise by means of a land into an outlet portion of the slot for containing or supporting the flame fronts when the burner is within a given heat output range, each outlet portion comprising at least one substantially constant relatively wide dimension section.

2. A burner as claimed in claim 1, in which each relatively narrow dimension exit opening terminates a slot portion of substantially constant dimension.

3. A burner as claimed in claim 1, in which each outlet portion comprises two or more relatively wide dimension sections; successive sections, in a direction away from the exit openings, being of increased but substantially constant dimensions and opening stepwise by means of a land into each other.

4. A burner as claimed in claim 1, in which each converging inlet portion has a varying angle of convergence.

5. A burner as claimed in claim 4, in which the converging inlet portion is of convex elliptical form.

6. A flame support for use in a fuel fired burner, which flame support comprises a plurality of elongate slots extending therethrough, each slot having a converging inlet portion, each slot including a portion which has an exit opening of a relatively narrow dimension, which exit opening opens stepwise by means of land into an outlet portion of the slot for containing or supporting flame fronts, when the flame support is incorporated in the burner, for a given heat output range, each outlet portion comprising at least one substantially constant relatively wide dimension section.

* * * * *

UNITED STATES PATENT AND TRADEMARK OFFICE

CERTIFICATE OF CORRECTION

PATENT NO. : 5,547,372

DATED : August 20, 1996

INVENTOR(S) : Colin SMITH

It is certified that error appears in the above-indentified patent and that said Letters Patent is hereby corrected as shown below:

On the title page, Items [22], [86], and [87] are missing. They should read:

--[22] PCT Filed: Nov. 12, 1993

[86] PCT No.: PCT/GB93/02337
§371 Date: Jul. 5, 1995
§102(e) Date: Jul. 5, 1995

[87] PCT Pub. No.: WO94/11675
PCT Pub. Date: May 26, 1994--

Signed and Sealed this

Nineteenth Day of November, 1996

*Attest:*

Bruce Lehman

BRUCE LEHMAN

*Attesting Officer*

*Commissioner of Patents and Trademarks*